US007107803B1

(12) United States Patent
Swanson

(10) Patent No.: US 7,107,803 B1
(45) Date of Patent: Sep. 19, 2006

(54) LOCKING TUBE APPARATUS

(76) Inventor: Neil J. Swanson, 3747 Newcastle Dr., Rochester Hills, MI (US) 48306

( * ) Notice: Subject to any disclaimer, the term of this patent is extended or adjusted under 35 U.S.C. 154(b) by 0 days.

(21) Appl. No.: 11/389,386

(22) Filed: Mar. 24, 2006

Related U.S. Application Data

(60) Provisional application No. 60/664,738, filed on Mar. 24, 2005.

(51) Int. Cl.
*E05B 37/20* (2006.01)

(52) U.S. Cl. ..... 70/289; 70/312; 70/290; 70/315; 70/163; 70/316; 70/317; 70/318

(58) Field of Classification Search ..... 70/312, 70/289, 290, 315–318, 163, 30, 26, 28; 463/9
See application file for complete search history.

(56) References Cited

U.S. PATENT DOCUMENTS

| | | | | | |
|---|---|---|---|---|---|
| 430,261 | A | | 6/1890 | Altemus, Jr. | |
| 615,381 | A | | 12/1898 | Brockett | |
| 761,254 | A | | 5/1904 | Rosedale | |
| 796,907 | A | * | 8/1905 | Burkle | 70/28 |
| 1,472,206 | A | * | 10/1923 | Burkle | 70/30 |
| 1,563,621 | A | | 12/1925 | Green | |
| 1,834,091 | A | * | 12/1931 | Cruse | 70/312 |
| 3,349,586 | A | * | 10/1967 | Russell et al. | 70/316 |
| 3,421,347 | A | | 1/1969 | Sotory | |
| 3,824,815 | A | | 7/1974 | Darling | |
| 5,259,619 | A | | 11/1993 | Rosewarne | |
| 5,899,099 | A | * | 5/1999 | Tsai | 70/26 |
| 5,934,120 | A | * | 8/1999 | Kuo | 70/312 |
| 6,109,996 | A | | 8/2000 | Ma et al. | |
| 6,729,167 | B1 | | 5/2004 | Fredrikksson | |
| 6,851,285 | B1 | | 2/2005 | Haas | |
| 2005/0288082 | A1 | * | 12/2005 | de la Huerga | 463/9 |

* cited by examiner

*Primary Examiner*—Brian E. Glessner
*Assistant Examiner*—William Schrode
(74) *Attorney, Agent, or Firm*—Brooks Kushman P.C.

(57) ABSTRACT

A combination locking tube comprising a base end cap connected to a base tube having a longitudinal channel and at least one notch contiguous with the channel, at least one locking ring having a longitudinal ring channel, a notch contiguous with the ring channel and an interlocking pin, each locking ring rotatably mounted on the base tube such that the locking ring's notch is positioned over a base tube notch, at least one indicia ring rotatably mounted on a locking ring having a plurality of characters and a plurality of teeth on its outer and inner surfaces, respectively, at least one static ring statically mounted to the base tube having an interlocking pin receptacle and an annular recess, an inner tube having an end cap and at least one pin received within the base tube.

9 Claims, 5 Drawing Sheets

LOCKING TUBE APPARATUS

CROSS-REFERENCE TO RELATED APPLICATIONS

This application claims the benefit of U.S. provisional application Ser. No. 60/664,738 filed Mar. 24, 2005.

BACKGROUND OF THE INVENTION

1. Field of the Invention

The present invention relates to a locking tube having a combination lock that may be reset to a new combination.

2. Background Art

Locking tubes are used to protect items or messages. One example of a locking tube is a "cryptex" device that is described in the recently published book THE DAVINCI CODE written by Dan Brown. In THE DAVINCI CODE, the ancient cryptex device contains a secret message that can only be accessed if the tube is properly opened by lining up coding rings on the exterior of the locking tube. Ancient cryptex devices were designed to be opened only by a single dedicated code that could not be changed. The purpose of such devices was to provide a "time capsule" type device that could only be opened by a person having access to the secret code.

Combination locking tubes have been proposed for different uses, such as a puzzle box disclosed in U.S. Pat. No. 430,261, as a child-safe pill box in U.S. Pat. No. 3,421,347 and as savings banks, for example, in U.S. Pat. Nos. 615,381; 761,251; and 6,109,996. These devices generally do not provide any mechanism for easily changing the secret code. With such devices, once the code is known, there is no challenge for persons knowing the code to reopen the container and the novelty of the device is lost. These types of devices are not useable as a novelty item that could be reused again and again with different codes being required to be determined to obtain access to the contents of the locking tube.

There is a need for a locking tube that may be reused with different combinations being selectable for obtaining access to the contents of the tube. Such a device could be used as part of a board game or as a party game where different teams of players are provided with clues that may assist them in breaking the code. Once the code is broken, there is a need for a way to make the device useful again by quickly resetting the device with a different code.

SUMMARY OF THE INVENTION

In accordance with at least one aspect of the present invention, a combination locking tube is provided. In at least one embodiment, referred to only for purposes of identification as the repositionable ring embodiment, the locking tube comprises a base end cap, a base tube connected to the base end cap, the base tube having a longitudinal base tube channel defined in a wall of the base tube and at least one notch contiguous with the base tube channel. At least one locking ring is rotatably mounted on the base tube. Each locking ring has a longitudinal ring channel defined in a wall of the ring, a notch contiguous with the ring channel and an interlocking pin. When the locking ring is mounted on the base tube, it is positioned so that when the ring channel is aligned with the base channel, the notch in the locking ring is positioned over one of the notches in the base tube. A number of indicia rings equal in number to the number of locking rings is/are rotatably mounted on respective locking rings. Each indicia ring has an outer surface and an inner surface. The outer surface of each indicia ring has a plurality of characters. The inner surface of each indicia ring has a plurality of teeth for receiving the interlocking pin of the locking ring. A number of static rings, equal in number to the number of locking rings, are statically mounted to the base tube adjacent to a respective pair of locking and indicia rings. Each static ring has an interlocking pin receptacle and an annular recess. An inner tube is provided having at least one pin protruding from a wall of the inner tube and an end cap at one end of the inner tube. The inner tube may be received within the base tube and each pin on the inner tube may be received within the base tube channel when the ring channel is aligned with the base tube channel. Each indicia ring rotates together with the locking ring about the base tube when the interlocking pin is engaged by the teeth of the indicia ring. When the interlocking pin is positioned within the interlocking pin receptacle of the static ring, the indicia ring rotates freely about the locking ring. The inner tube is insertable into, and removable from, the base tube only when the ring channel is aligned with the base tube channel. When each pin of the inner tube is positioned within a notch in the base tube and simultaneously within a notch of a respective locking ring, each pin can be manipulated to move its respective locking ring back and forth between a first and second position. In the first position, the interlocking pin is engaged by the teeth of the indicia ring. In the second position, the interlocking pin is positioned within the interlocking pin receptacle of the static ring.

In another embodiment of the repositionable ring embodiment, the base end cap has a longitudinal base end cap groove defined in the inner surface of a wall of the base end cap and the base end cap groove is aligned with the base tube channel when the base end cap is connected to the base tube.

In another embodiment of the repositionable ring embodiment, a portion of an outer surface of the locking ring that is adjacent to the static ring is beveled to facilitate the locking ring being received within the annular recess of the static ring.

In another embodiment of the repositionable ring embodiment, at least one notch in the base tube is in the shape of the capital letter "L". In yet another embodiment, the width of the notch in the base tube is equal to the width of the notch in the locking ring.

In another embodiment, referred to only for purposes of identification as the removably attached characters embodiment, a combination locking tube is provided having a base end cap, a base tube connected to the base end cap, the base tube having a longitudinal channel through at least a portion of a wall of the tube, at least one indicia ring, each ring having a longitudinal channel through a wall of the ring, each indicia ring being rotatably mounted on the base tube and having a plurality of characters provided on a strip that is removably attached to an outer surface of the indicia ring, an inner tube having at least one pin and an end cap, the inner tube being received within the base tube and each pin being received within a longitudinal channel formed by the alignment of the channel in each indicia ring with the channel and the base tube, and wherein the inner tube is insertable into, and removable from, the base tube only when the channel in each indicia ring is aligned with the channel in the base tube.

In another embodiment of the removably attached characters embodiment, the characters are individually removable from the indicia ring.

In other embodiments of both the repositionable ring embodiment and the removably attached characters embodiment, the base end cap has a longitudinal base end cap groove defined in the inner surface of a wall of the base end cap and wherein the base end cap groove is aligned with the base tube channel when the base end cap is connected to the base tube.

In other embodiments of both the repositionable ring embodiment and the removably attached characters embodiment, there are at least three locking rings.

In other embodiments of both the repositionable ring embodiment and the removably attached characters embodiment, the base tube channel extends through the entire length of the base tube.

In still other embodiments of both the repositionable ring embodiment and the removably attached characters embodiment, the characters on the outer surface of each indicia ring includes numbers and symbols.

DETAILED DESCRIPTION OF THE PREFERRED EMBODIMENT(S)

Figure 1:
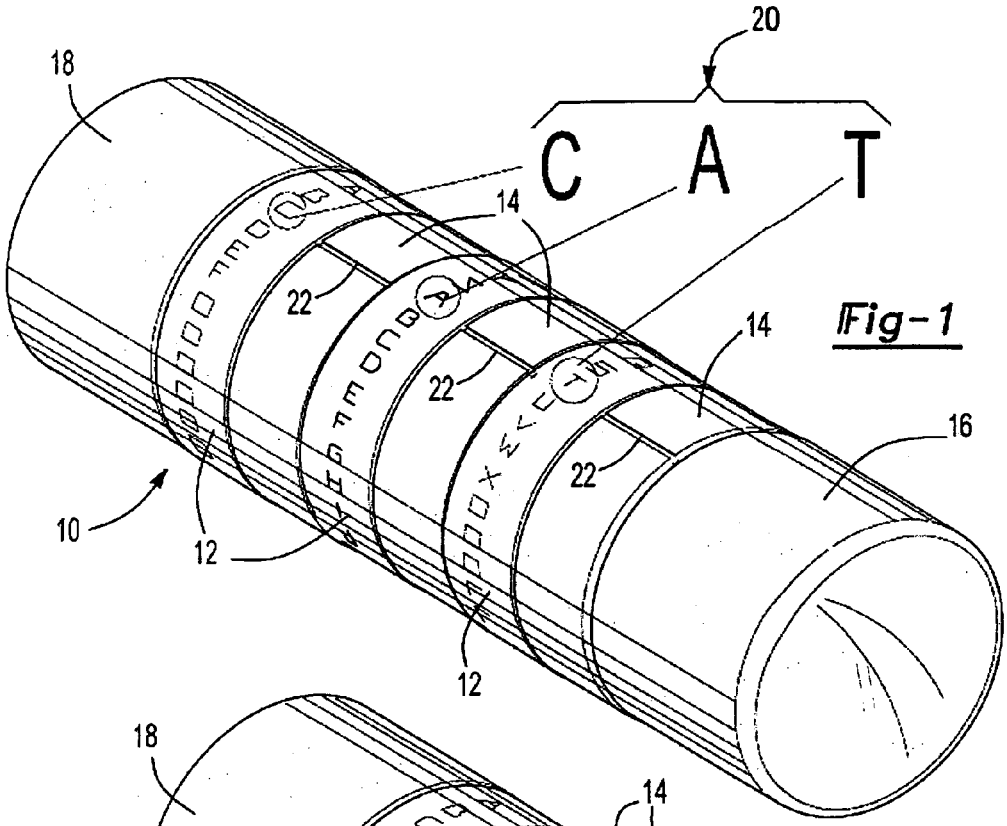
FIG. 1 is a perspective view of a locking tube in its closed position made in accordance with the present invention.

Referring to FIG. 1, a locking tube 10 having rotatable indicia rings 12 and static rings 14 is illustrated in its closed or locked condition. The rotatable indicia rings 12 are marked with letters of the alphabet but could also be marked with numbers or other characters. The static rings 14 do not rotate, but the indicia rings 12 may be rotated relative to the static rings 14. The locking tube 10 also includes a base end cap 18 that closes one end of the locking tube 10. A code message 20, in this case the letters C-A-T, is a secret code that allows the locking tube 10 to be opened when the correct three letters making up a code message 20 are aligned with alignment indicators 22. It should be understood that any other number of rings could be provided by simply repeating iterations of the construction as described below depending upon the number of letters desired in the code word.

Figure 2:
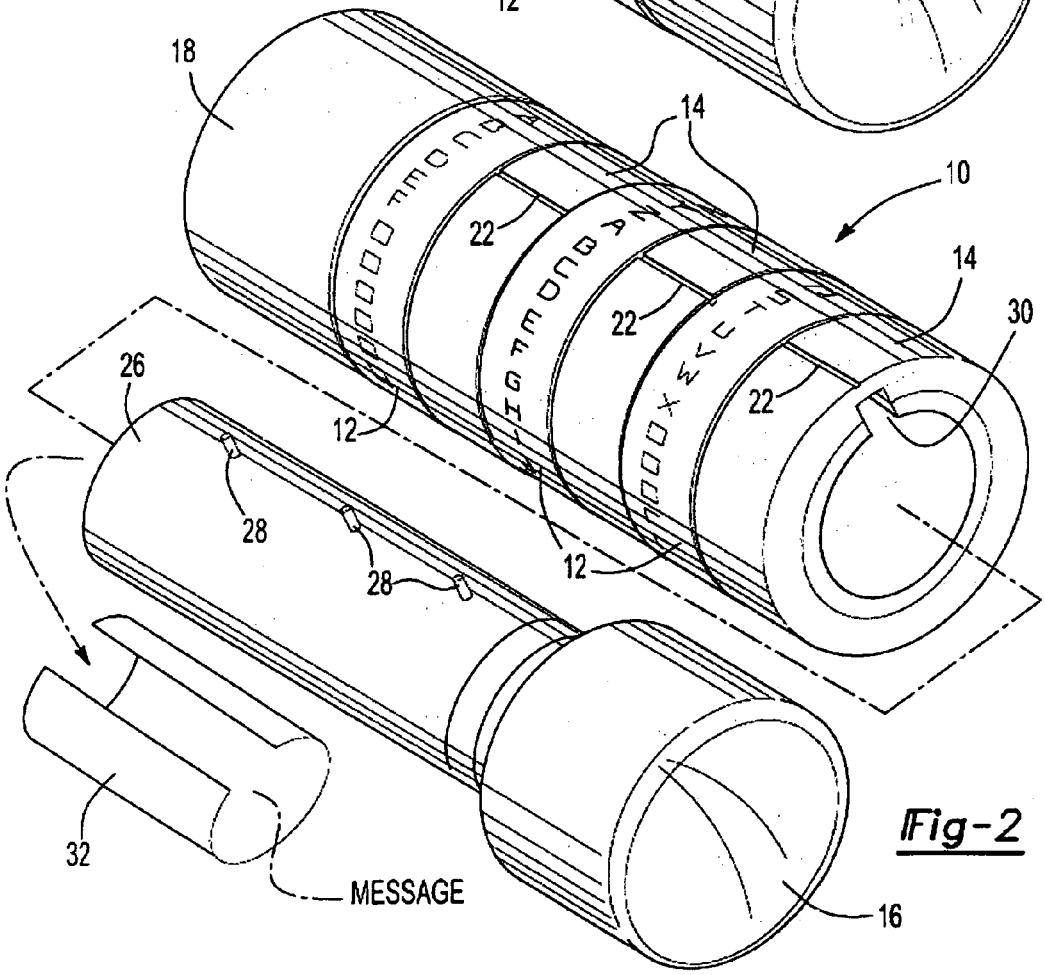
FIG. 2 is a partially exploded perspective view showing the locking tube of FIG. 1 in its open condition.

Referring to FIG. 2, the locking tube 10 is shown in its open condition. The removable end cap 16 is shown removed from the locking tube 10. The end cap 16 is connected to an inner tube 26 that supports a plurality of pins 28 corresponding in number to the number of rotatable indicia rings 12. The end cap 16 and inner tube 26 are removeable from the locking tube 10 only when the alignment of the indicia rings 12 and static rings 14 forms an insertion/removal slot 30. This occurs when the answer to the code message 20 is set when the locking tube is mechanically programmed as will be more fully described below. A message 32, or other small article, may be placed within the inner tube 26 and the inner tube placed inside the locking tube 10 by sliding the pins 28 through the slot 30 when it is in its aligned, or code matched, position.

Figure 3:
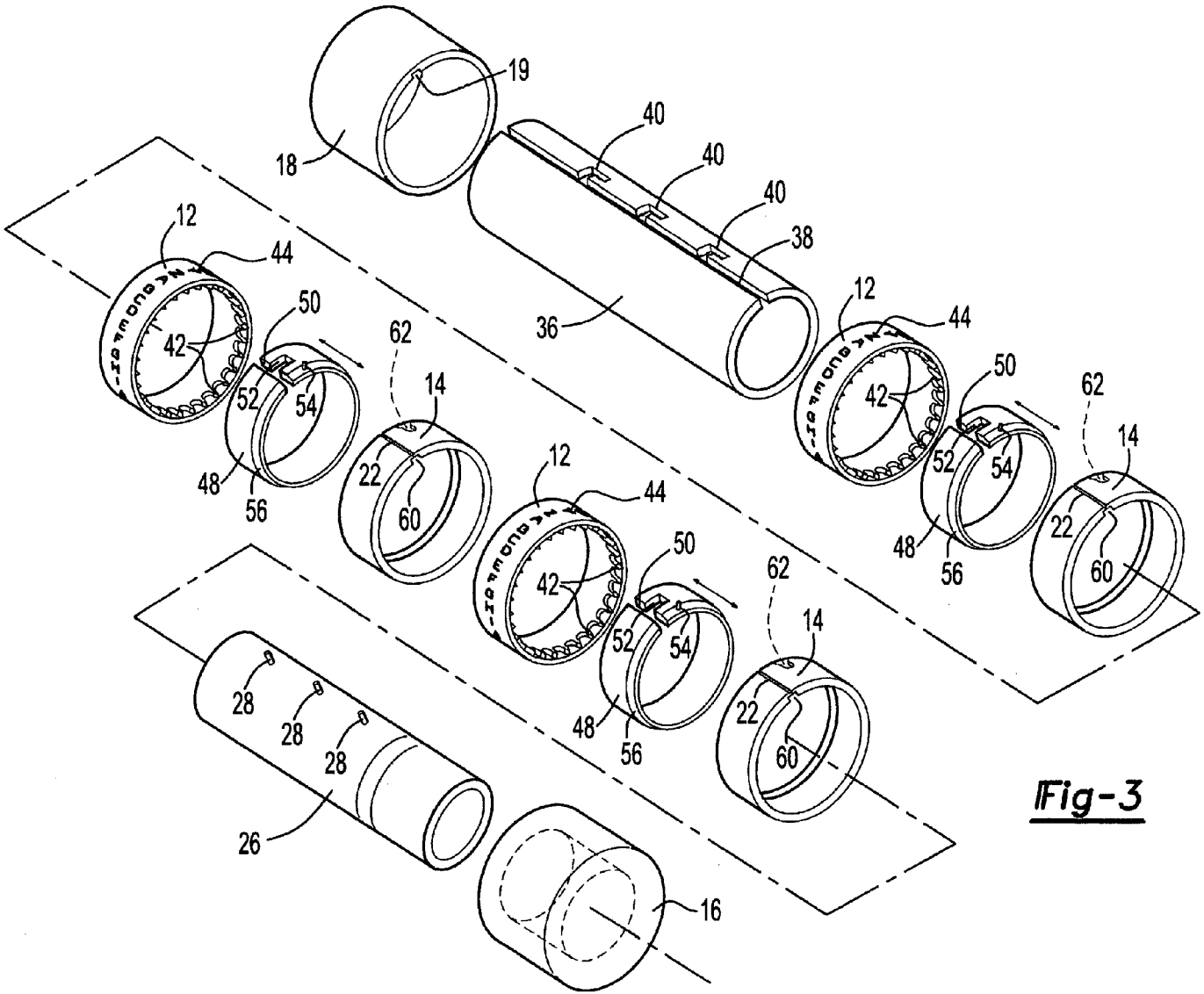
FIG. 3 is an exploded perspective view of a locking tube made according to one embodiment of the present invention.

Referring to FIG. 3, the component parts of the locking tube 10 are described in greater detail. The base end cap 18 is secured to a base tube 36. The base end cap 18 has a longitudinal base end cap groove 19 defined in the inner surface of a wall of the base end cap 18. The base tube 36 includes an inner slot portion 38 of the slot 30 that extends linearly in an axial direction through the base tube 36. A plurality of L shaped notches 40 corresponding to the number of indicia rings 12 are provided at spaced locations along the inner slot portion 38 of the base tube 36.

Three rotatable indicia rings 12 are shown in the embodiment illustrated in FIG. 3. Each of the indicia rings 12 has a plurality of teeth 42 formed on an inner surface of indicia ring 12. An identification layer 44, that may include letters or other code indicia, is provided on the outer surface of the indicia ring 12 and covers or conceals the teeth 42. The indicia rings 12 are received on a locking ring 48 that is in turn received on the base tube 36. The locking ring 48 has a lock ring outer slot portion 50 that forms the outer portion of the slot 30. A notch 52 opens into the outer slot portion 50. An interlocking pin 54 is secured to a beveled surface 56 on one axial end of the locking ring 48. The interlocking pin 54 is arranged to be selectively received between adjacent pairs of the teeth 42. The beveled surface 56 facilitates insertion of the locking ring 48 into the static ring 14.

Static rings 14 are affixed to the base tube 36 at locations adjacent to the side of the indicia rings 12 having the teeth 42. A static ring outer slot portion 60 also forms part of the outer portion of the slot 30 that extends axially through the static ring 14. An interlocking pin receptacle 62 is formed on the side of the static ring 14 adjacent to the teeth 42 on the indicia ring 12. The assembly of indicia ring 12 to the locking ring 48 and static ring 14 is repeated three times for the embodiment shown in FIG. 3. It should be understood that four, five or more iterations of this assembly could provide a locking tube having three, four, five or more letters or markings that must be aligned to open and close the locking tube 10. The inner tube 26 may be inserted into the base tube 36 only when all of the portions of the slot 30 are in alignment. Slot 30 is in alignment when the locking ring outer portions 50 and static ring outer slot portions 60 are axially aligned with the inner portion of the slot 38.

Figure 4:
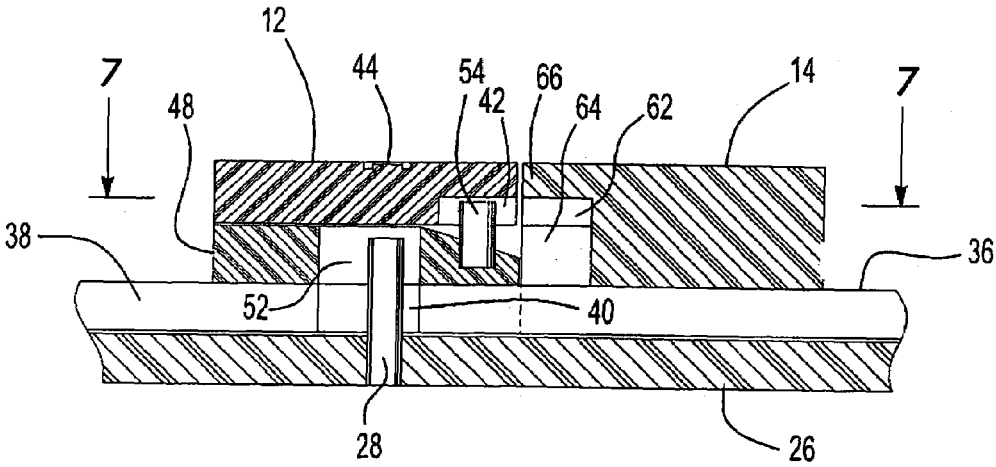
FIG. 4 is a fragmentary schematic cross-sectional view of the locking tube showing one lettered ring and one stationary ring with cooperating locking elements.

Referring now to FIG. 4, operation of the locking tube 10 will be further described with reference to one of the locking rings 48, indicia rings 12, static rings 14, and related cooperative structure. Pin 28 is secured to the inner tube 26 and extends through the inner slot portion 38. The pin 28 is partially disposed in the notch 52 that is formed in the locking ring 48. Interlocking pin 54 is secured to the locking ring 48 and is received in a recess formed between adjacent teeth 42 so that when the indicia ring 12 is rotated, the locking ring 48 rotates with the indicia ring 12. Locking ring 48 is only connected to the indicia ring 12 by means of the pin 54 and is not otherwise radially secured to the base tube 36.

Figure 5:
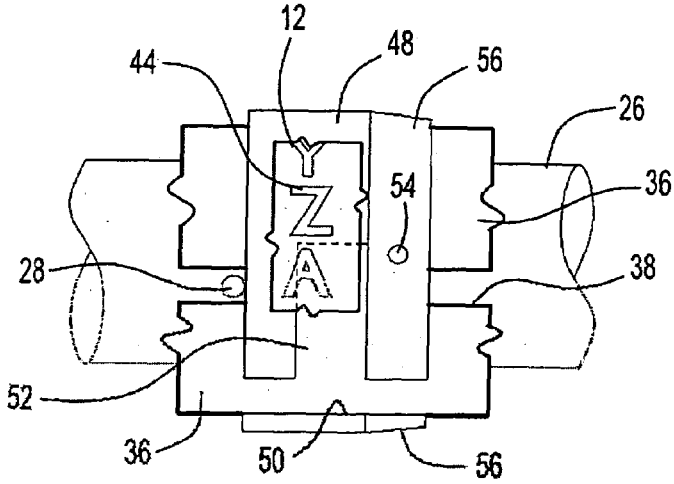
FIG. 5 is a fragmentary elevation view showing the letter ring locking the tube.

Referring to FIG. 5, a rotatable indicia ring 12 is shown blocking movement of the pin 28 through the insertion/removal slot 30. The inner tube 26 cannot be withdrawn because the pin 28 engages the side of the locking ring 48 that is pinned to the indicia ring 12 by the interlocking pin 54.

Figure 6:
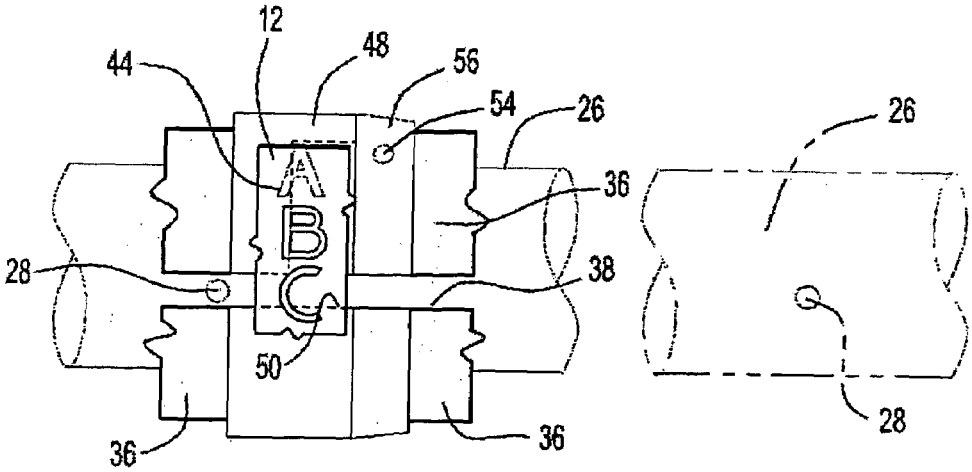
FIG. 6 is a fragmentary elevation view showing the letter ring in position for opening the tube.

Referring to FIG. 6, the indicia ring 12 has been rotated to its unlocked position in which the pin 28 is disposed in the slot 30 that is formed by the alignment of the inner slot portion 38 and outer slot portion 50.

Figure 7:
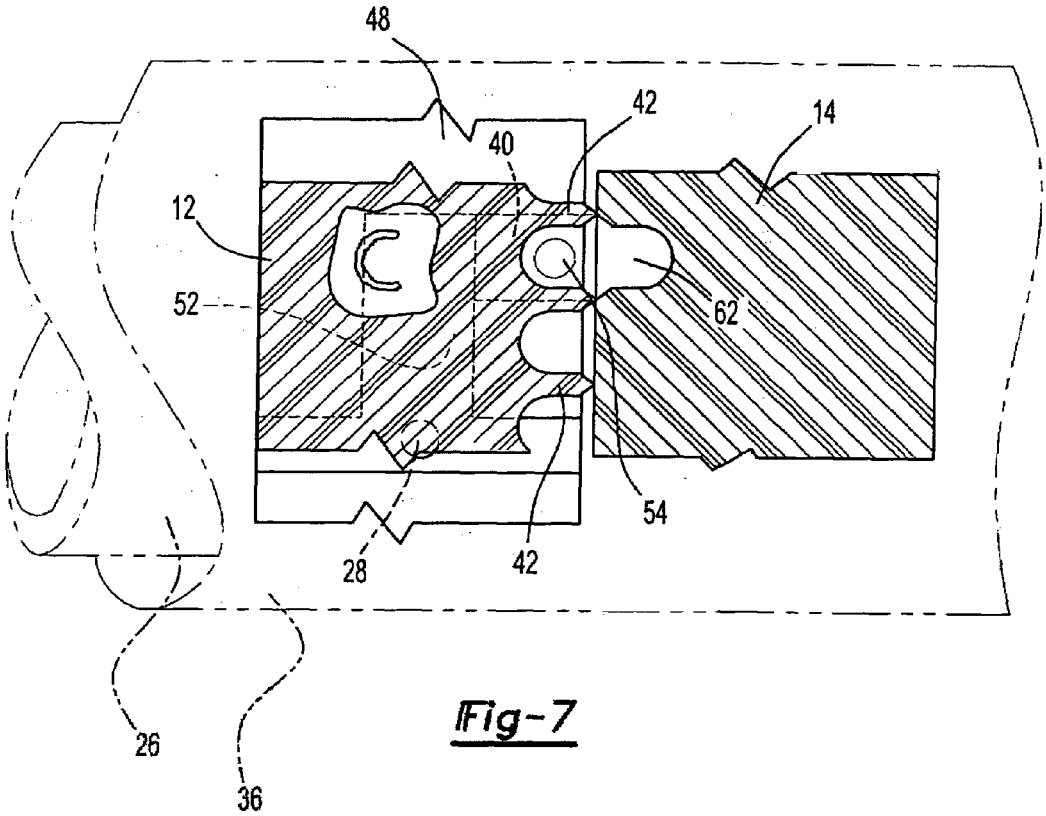
FIG. 7 is a cross-sectional view, taken along the line 7—7 in FIG. 4, showing the letter ring locked to the locking ring.

Reprogramming the locking tube will be described with reference to FIGS. 7–10 below. Referring to FIG. 7, the rotatable indicia ring 12 is shown adjacent to the static ring 14. Interlocking pin 54 is shown disposed between two adjacent teeth 42. One of the pins 28 is shown in phantom and generally in alignment with a notch 52 formed in the locking ring 48. In this position, the pin 28 can be moved into the notch 52 and is also moved into and aligned with one of the notches 40 in the base tube 36. The notch in the locking ring 48 can be smaller than the notch 40 in the base tube 36 to allow the pin 28 to be used to shift the locking ring 48 relative to the rotatable indicia ring 12 and the base tube 36. Alternatively, each notch in the base tube can be of equal width as the notch in each locking ring, the notch in the base tube being in the shape of a capital letter "L" to facilitate shifting the locking ring relative to the indicia ring.

Figure 8:
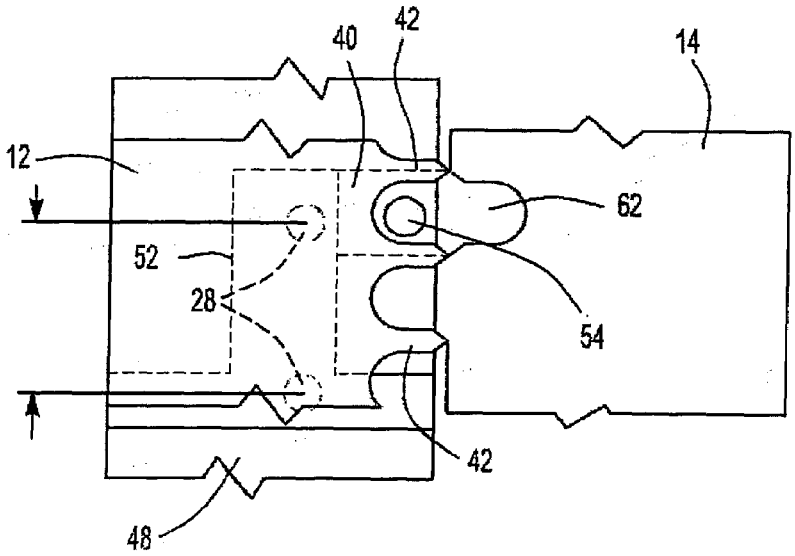
FIGS. 8 and 9 are cross-sectional views similar to the view shown in FIG. 7 showing the relative movement of the interlocking element and the letter ring as they are moved to be released for recoding.
Figure 9:
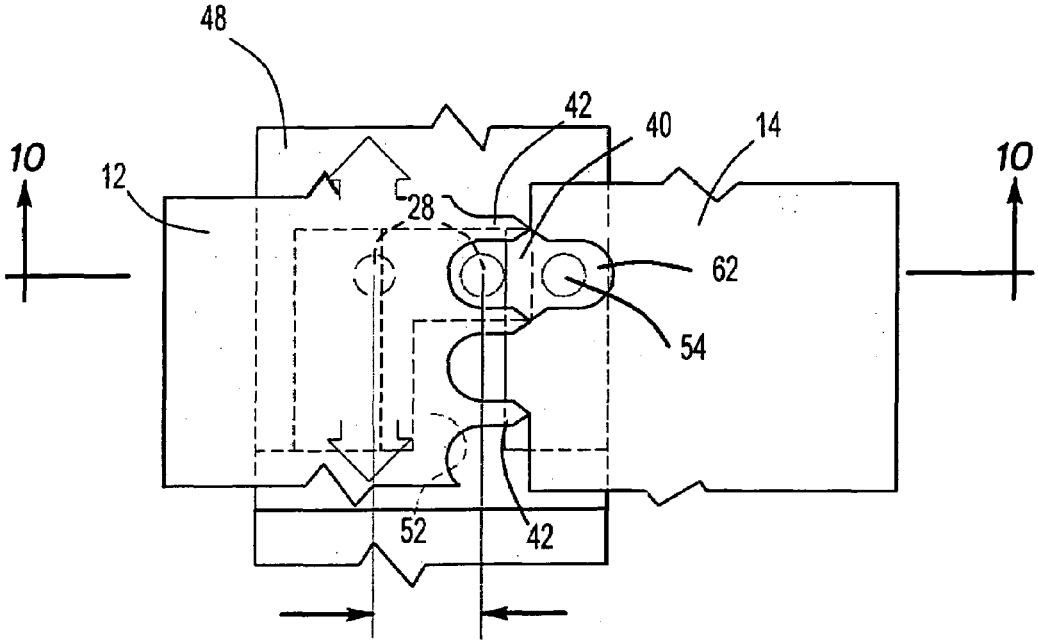

Referring to FIG. 8, the inner tube 26 may be rotated in a clockwise direction to cause the pin 28 to enter the notch 52 in the locking ring 48 and the notch 40, as shown in FIGS. 3 and 4, formed in base tube 36. The degree of rotation may be approximately 30° depending upon the depth of the notches 40 and 52. As shown in FIG. 9, the locking ring 48 is pulled in the removal direction by the pin 28 to shift the locking ring 48 until the interlocking pin 54 is moved from between the teeth 42 and received in the receptacle 62. The pin 28 is then rotated back in a counter-clockwise direction until it is aligned with the insertion/removal slot 30 so that the inner tube 26 may be removed from the base tube 36 at this point to allow the indicia rings 12 to be rotated to select a new code word. However, if the notch in the base tube 36 is in the shape of a capital letter "L", then the inner tube 26 cannot be removed during the reprogramming process.

Figure 10:
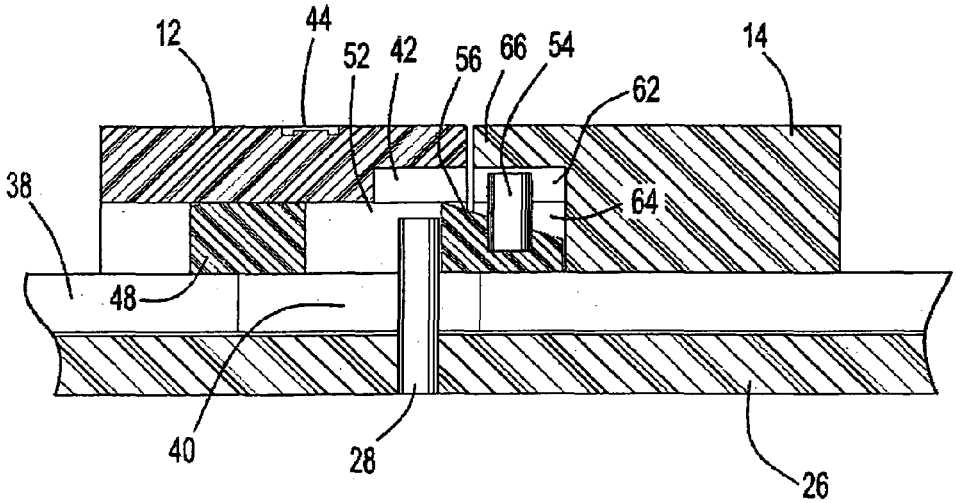
FIG. 10 is a fragmentary schematic cross-sectional view, taken along the line 10—10 in FIG. 9.

Referring to FIGS. 9 and 10, the indicia ring 12 and static ring 14 are shown with interlocking pin 54 shifted into the interlocking pin receptacle 62 that is formed in the static ring 14. The locking ring 48 is shown axially shifted relative to the indicia ring 12 so that the pin 54 is shifted out of the space between the adjacent teeth 42. The pin 28 is shown in phantom in FIG. 9 in two positions. The lock position is the left-most position in FIG. 9. The right-most depiction of pin 28 is the unlocked position showing the pin 28 contacting the side of the notch 52 as the locking ring 48 is shifted axially relative to both the indicia ring 12 and the base tube 36. In this position, the indicia ring 12 is free to rotate relative to locking ring 48 since interlocking pin 54 is no longer securing the two rings together.

An annular recess 64 is formed by an annular extension 66 that extends toward the indicia ring 12 on one side of the static ring 14. The pin 54 is received in the interlocking pin receptacle 62 when the beveled surface 56 is inserted into the recess 64. The indicia ring 12 may be rotated without changing the position of the pin 28 relative to the base tube 36 and locking ring 48. In this position, a letter can be selected for one of the portions of the code word so that when the selected letter is aligned with the alignment indicator 22, the slot 30 is in its aligned condition.

The code letter is fixed, or programmed, by shifting the locking ring 48 back to the position illustrated in FIGS. 4 and 7 by the pin 28 pushing against the side of notch 52 until the interlocking pin 54 is received between two adjacent teeth 42 that are aligned with a letter on the identification layer of the indicia ring 12. Programming the locking tube 10 is performed when the slot 30 is in alignment to permit insertion/removal of the inner tube 26 from the locking tube 10.

It should be noted that all three of the pins 28 are moved together relative to their associated locking rings 48 with the same programming steps. Once the indicia rings 12 are rotated to the desired code, the inner tube 26 may be reinserted through the insertion/removal slot 30 until the pins 28 are aligned with the notches 40 and 52. The pin 28 is then rotated to be received within the notches 40 and 52. The end cap 16 is then pushed to apply pressure on the pin 28 that forces the locking ring 48 to be moved into the position shown in FIG. 7 with the locking ring 48 being aligned with the indicia ring 12. The interlocking pin 54 is moved between two adjacent teeth 42 that sets the selected letter for each of the indicia rings 12.

The inner tube 26 may then be turned in a counter-clockwise motion until the pins 28 are aligned with the slot 30. The end cap 16 and inner tube 26 are then pushed further towards the base end cap until the pin 28 is located adjacent to the side of the indicia ring 12 as shown in FIG. 6. The indicia rings 12 may then be turned, as shown in FIG. 5, placing the code letters at different random locations to disguise the code message 20.

The locking tube 10 may be used as a game in which participants are provided with clues that help them guess the secret code. The secret code would be mechanically programmed as described above prior to the beginning of each round of the game so that a different code word may be established that allows unlocking and opening of the tube. When the letters or other indicia are aligned with the alignment indicator 22, the pins 28 are permitted to pass through the entire length of the insertion/removal slot 30. The inner tube 26 may be removed from the locking tube 10 to permit access to the message 32, or object, contained within the inner tube 26.

A simplified embodiment of the present invention may be described with reference to FIGS. 1 and 2. A locking tube may be provided in which the indicia rings are not reprogrammed by means of the interconnection of the locking ring 48 with the indicia ring 12. This simplified embodiment may be provided without requiring the notches 40 and 52, teeth 42 and other cooperating elements between the indicia rings 12 and static rings 14. In this embodiment, pressure sensitive adhesive tape bearing the indicia may be applied to the rotatable indicia rings at different radial locations to permit the locking tube 10 to be recoded by removing and reinstalling the tape on the indicia ring 12. Programming the simplified locking tube 10 may be performed by aligning the inner tube 26 and base tube 36 so that the elements of the insertion/removal slot 30 are in axial alignment. In this position, the inner tube 32 may be received within or removed from the locking tube 10. The pressure sensitive adhesive strip bearing the indicia is aligned on indicia ring 12 so that the desired code letters of the code message 20 are aligned with alignment indicators 22. While this locking tube is of simpler construction, it may require replacement of the pressure sensitive adhesive strips periodically to allow for continued reuse. As the adhesive strips are repeatedly applied and removed from the indicia rings 12, their adhesive properties may diminish and the strips may become worn. The adhesive strips require periodic replacement with new strips.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A combination locking tube comprising:

a base end cap;

a base tube connected to the base end cap, the base tube having a longitudinal base tube channel defined in a wall of the base tube and at least one notch contiguous with the base tube channel;

at least one locking ring, each locking ring having a longitudinal ring channel defined in a wall of the ring, a notch contiguous with the ring channel, and an interlocking pin, each locking ring being rotatably mounted on the base tube and positioned so that when the ring channel is aligned with the base tube channel, the notch in the locking ring is positioned over one of the notches in the base tube;

a number of indicia rings equal in number to the number of locking rings, each indicia ring being rotatably mounted on a respective locking ring, each indicia ring having an outer surface and an inner surface, the outer surface having a plurality of characters, the inner surface having a plurality of teeth for receiving the interlocking pin;

a number of static rings equal in number to the number of locking rings, each static ring being statically mounted on the base tube adjacent to a respective pair of locking and indicia rings, each static ring having an interlocking pin receptacle, and an annular recess;

an inner tube having at least one pin and an end cap, the inner tube being received within the base tube and each pin being received within the base tube channel when in alignment with the ring channel;

wherein each indicia ring rotates together with the locking ring about the base tube when the interlocking pin is engaged by the teeth of the indicia ring and wherein the indicia ring rotates freely about the locking ring when the interlocking pin is positioned within the interlocking pin receptacle of the static ring;

wherein the inner tube is insertable into and removeable from the base tube only when the ring channel is aligned with the base tube channel;

and wherein each pin of the inner tube, when positioned within a notch in the base tube and the notch in a respective locking ring, can be manipulated to move the locking ring back and forth between a first position where the interlocking pin is engaged by the teeth of the indicia ring and a second position in which the interlocking pin is positioned within the interlocking pin receptacle of the static ring.

2. The combination locking tube of claim 1 wherein the base end cap has a longitudinal base end cap groove defined in the inner surface of a wall of the base end cap and wherein the base end cap groove is aligned with the base tube channel when the base end cap is connected to the base tube.

3. The combination locking tube of claim 1 wherein the static ring has a longitudinal groove defined in an internal surface of a wall of the static ring, said groove being aligned with the base tube channel when the static ring is mounted on the base tube.

4. The combination locking tube of claim 1 wherein a portion of an outer surface of the locking ring that is adjacent to the static ring is beveled to facilitate the locking ring being received within the annular recess of the static ring.

5. The combination locking tube of claim 1 wherein at least one notch in the base tube is in the shape of the capital letter "L".

6. The combination locking tube of claim 5 wherein the width of the notch in the base tube is equal to the width of the notch in the locking ring.

7. The combination locking tube of claim 1 wherein there are at least three locking rings.

8. The combination locking tube of claim 1 wherein the base tube channel extends through the entire length of the base tube.

9. The combination locking tube of claim 1 wherein the characters on the outer surface of at least one indicia ring includes numbers and symbols.

* * * * *